US011971033B2

(12) United States Patent
Goss

(10) Patent No.: US 11,971,033 B2
(45) Date of Patent: Apr. 30, 2024

(54) INTERNAL GEAR FLUID MACHINE

(71) Applicant: ECKERLE TECHNOLOGIES GMBH, Malsch (DE)

(72) Inventor: Alexander Goss, Karlsruhe (DE)

(73) Assignee: ECKERLE TECHNOLOGIES GMBH, Malsch (DE)

( * ) Notice: Subject to any disclaimer, the term of this patent is extended or adjusted under 35 U.S.C. 154(b) by 0 days.

(21) Appl. No.: 18/017,206

(22) PCT Filed: Jul. 19, 2021

(86) PCT No.: PCT/EP2021/070136
§ 371 (c)(1),
(2) Date: Jan. 20, 2023

(87) PCT Pub. No.: WO2022/018022
PCT Pub. Date: Jan. 27, 2022

(65) Prior Publication Data

US 2023/0296093 A1 Sep. 21, 2023

(30) Foreign Application Priority Data

Jul. 24, 2020 (DE) ..... 10 2020 209 407.1

(51) Int. Cl.
*F04C 2/10* (2006.01)
*F04C 15/06* (2006.01)

(52) U.S. Cl.
CPC ..... *F04C 2/101* (2013.01); *F04C 15/06* (2013.01); *F04C 2240/54* (2013.01)

(58) Field of Classification Search
CPC ..... F04C 14/04; F04C 15/06; F04C 2/101; F04C 2/102; F04C 2240/54
See application file for complete search history.

(56) References Cited

U.S. PATENT DOCUMENTS 3,597,129 A 8/1971 Crowther
3,824,041 A 7/1974 Rystrom
6,659,748 B1 12/2003 Arbogast et al.

FOREIGN PATENT DOCUMENTS

CH 439983 A 7/1967
DE 7538960 U 6/1977
(Continued)

OTHER PUBLICATIONS

International Search Report (English and German) and Written Opinion of the International Searching Authority (German) issued in PCT/EP2021/070138, dated Oct. 29, 2021; ISA/EP.
(Continued)

*Primary Examiner* — Anthony Ayala Delgado
(74) *Attorney, Agent, or Firm* — Harness, Dickey & Pierce, P.L.C.; Stephen T. Olson

(57) ABSTRACT

An internal gear fluid machine has a first gearwheel having external toothing mounted rotatably about a first axis of rotation and a second gearwheel having internal toothing meshing in regions with the external toothing in an engagement region and mounted rotatably about a second axis of rotation different from the first axis of rotation. A filler piece is arranged between the first gearwheel and the second gearwheel away from the meshing region which bears on the one side against the external toothing and on the other side against the internal toothing, in order to divide a fluid space present between the first gearwheel and the second gearwheel into a first fluid chamber and a second fluid chamber, and housing walls of a machine housing of the internal gear fluid machine being arranged in the axial direction with respect to the first axis of rotation on both sides of the first gearwheel and of the second gearwheel. The second gearwheel is surrounded in the circumferential direction to form a hydrostatic bearing by a bearing recess formed in the machine housing, which bearing recess at least partially
(Continued)

Figure 1:
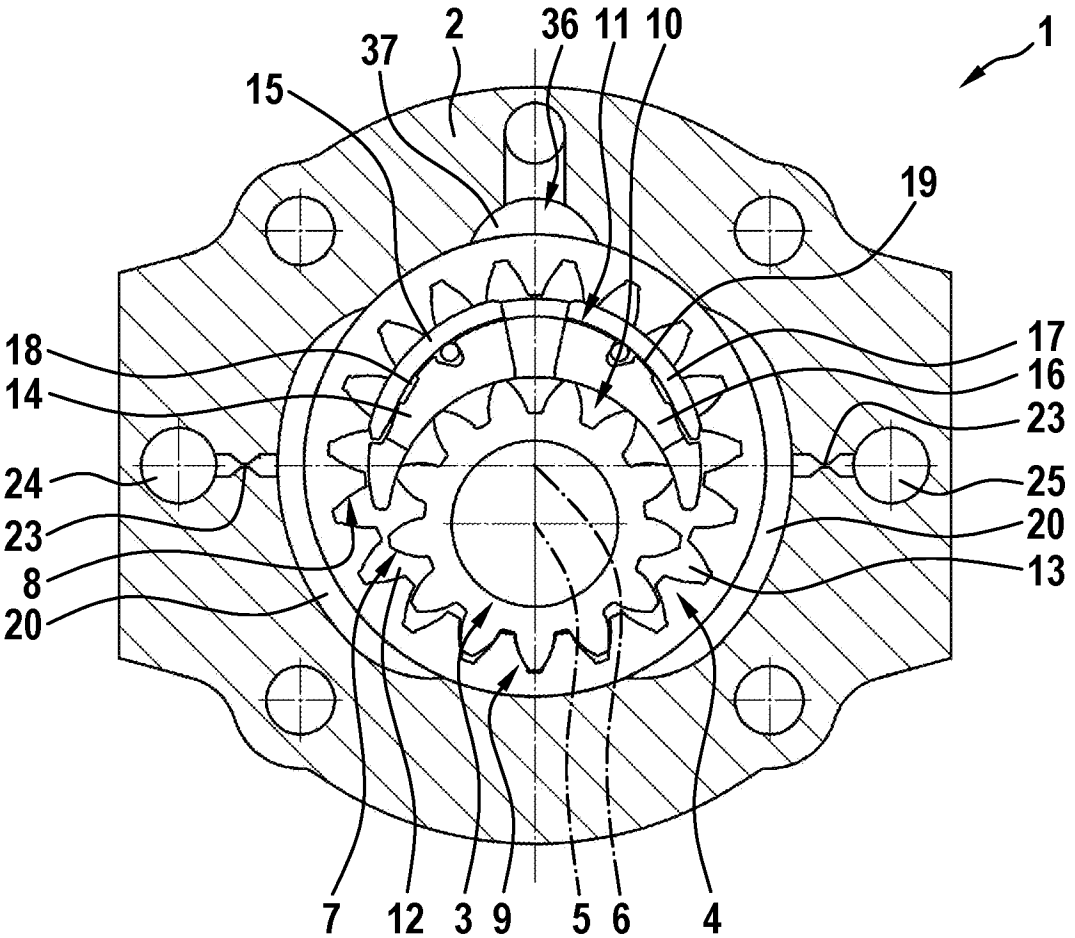

overlaps the second gearwheel in the axial direction and is fluidically connected to a fluid connection of the internal gear fluid machine via a fluid line having a flow resistance.

10 Claims, 4 Drawing Sheets

(56) References Cited

FOREIGN PATENT DOCUMENTS

| | | | |
|---|---|---|---|
| DE | 2547994 | C2 | 7/1985 |
| DE | 4421255 | C1 | 6/1995 |
| DE | 19930911 | C1 | 7/2000 |
| DE | 102009024216 | A1 | 12/2009 |
| DE | 102008053318 | A1 | 4/2010 |
| DE | 102011100105 | A1 | 10/2012 |
| DE | 102011075415 | A1 | 11/2012 |
| DE | 102018008905 | A1 | 5/2020 |
| EP | 0012015 | A1 | 6/1980 |
| JP | S54-152209 | A | 11/1979 |
| JP | 2017-101796 | A | 6/2017 |
| WO | WO-2010-095505 | A1 | 8/2010 |

OTHER PUBLICATIONS

International Preliminary Report on Patentability issued in PCT/EP2021/070138, dated Feb. 2, 2023.

International Preliminary Report on Patentability issued in PCT/EP2021/070136, dated Feb. 2, 2023.

International Search Report (English and German) and Written Opinion of the International Searching Authority (German) issued in PCT/EP2021/070136, dated Oct. 22, 2021; ISA/EP.

INTERNAL GEAR FLUID MACHINE

CROSS REFERENCE TO RELATED APPLICATIONS

This application is a U.S. National Phase Application under 35 U.S.C. 371 of International Application No. PCT/EP2021/070136, filed on Jul. 19, 2021, which claims priority to German Patent Application No. 10 2020 209 407.1, filed on Jul. 24, 2020. The entire disclosures of the above applications are expressly incorporated by reference herein.

The invention relates to an internal gear fluid machine having a first gearwheel which has external toothing and is mounted rotatably about a first axis of rotation, and a second gearwheel which has internal toothing which meshes in regions with the external toothing in an engagement region and is mounted rotatably about a second axis of rotation different from the first axis of rotation, a filler piece being arranged between the first gearwheel and the second gearwheel away from the engagement region, which, on the one hand, bears against the external toothing and, on the other hand, bears against the internal toothing in order to subdivide a fluid space present between the first gearwheel and the second gearwheel into a first fluid chamber and a secand fluid chamber, and housing walls of a machine housing of the internal gear fluid machine being arranged in the axial direction with respect to the first axis of rotation on both sides of the first gearwheel and of the second gearwheel.

For example, DE 199 30 911 C1 is known from the prior art. This describes an internal gear fluid machine for reversing operation in a closed circuit; with an externally toothed pinion; with an internally toothed ring gear which meshes with the pinion; with a housing; with a filling which fills the crescent-shaped space between pinion and ring gear; the filling comprises two identical filler pieces; a stop pin is provided which is mounted in the housing and against which the filler pieces are supported with their end faces. Axial discs are provided on both sides of the pinion. An axial pressure field is provided between the outside of each axial disc and the relevant housing wall, and a control field is provided between the inside of each axial disc and the pinion. At least one control slot is connected to each control field, which tapers towards its free end.

Furthermore, the publication DE 10 2008 053 318 A1 discloses a reversibly operable gearwheel machine comprising a housing in which two gearwheels are arranged. A first bearing chamber and a second bearing chamber are provided, wherein in a first operating direction of the gearwheel machine the first bearing chamber and in an opposite second operating direction the second bearing chamber is acted upon by a hydraulic fluid pressure and forms a hydrostatic bearing for a gearwheel. Furthermore, a vehicle steering system is described comprising a hydraulic circuit, a hydraulic cylinder and a gear machine which operates as a pump and applies hydraulic pressure to a first working chamber in its first operating direction and to a second working chamber of the hydraulic cylinder in its second operating direction.

It is the objective of the invention to propose an internal gear fluid machine which has advantages over known internal gear fluid machines, in particular enabling a higher efficiency due to a particularly effective mounting of the gearwheels in the machine housing with simultaneously low fluid loss.

According to the invention, this is achieved with an internal gear fluid machine having the features of claim 1. It is provided that the second gearwheel is surrounded in the circumferential direction for the formation of a hydrostatic bearing at least in some areas by at least one bearing recess formed in the machine housing, which bearing recess at least partially engages over the second gearwheel in the axial direction and is fluidically connected to a fluid connection of the internal gear fluid machine via a fluid line having a flow resistance.

The internal gear fluid machine is a fluid conveying device and is used to convey a fluid, for example a liquid or a gas. For this purpose, the internal gear fluid machine has two gearwheels, namely the first gearwheel and the second gearwheel. The first gearwheel can also be referred to as a pinion and the second gearwheel as a ring gear. The pinion gear has the external toothing and the ring gear has the internal toothing. The external toothing and the internal toothing mesh with each other in certain areas as seen in the circumferential direction, i.e. they mesh with each other in certain areas, namely in the engagement region. The two gearwheels are provided for conveying fluid and for this reason are designed in such a way that they cooperate with each other during a rotary movement for conveying the fluid and in doing so engage or mesh with each other.

The first gearwheel is preferably coupled to an input shaft or drive shaft of the internal gear fluid machine, preferably rigidly and/or detachably or permanently. In the case of detachable coupling, for example, there is a plug-in pinion which is plugged onto the drive shaft and can be detached from it without damage. Preferably, the plug-in pinion has an internal toothing that cooperates with an external toothing of the input shaft for drive coupling of the plug-in pinion with the input shaft. For example, the first gearwheel is rotatably supported by the input shaft in a machine housing of the internal gear fluid machine. Preferably, the first gearwheel is arranged on the input shaft so that it always has the same rotational speed as the input shaft during operation of the internal gear fluid machine.

Both the first gearwheel and the second gearwheel are arranged in the machine housing and rotatably mounted therein. The first gearwheel is rotatably mounted about the first axis of rotation, whereas the second gearwheel is rotatably mounted about the second axis of rotation. The first axis of rotation can also be referred to as the pinion axis of rotation and the second axis of rotation as the ring gear axis of rotation. Seen in cross-section, i.e. in a sectional plane perpendicular to the axes of rotation, the first gearwheel is arranged in the second gearwheel, namely in such a way that the external toothing of the first gearwheel meshes or engages with the internal toothing of the second gearwheel in the engagement region. This means that a rotational movement of the first gearwheel is directly transmitted to the second gearwheel and, conversely, a rotational movement of the second gearwheel is directly transmitted to the first gearwheel.

The engagement region is arranged fixed to the housing, for example, and therefore does not rotate with the first gearwheel or the second gearwheel. In the engagement region, a tooth of one of the toothings engages in a tooth space of the other of the toothings. The tooth space is bounded in the circumferential direction by teeth of the respective toothing. For example, a tooth of the internal toothing engages in a tooth space of the external toothing or, conversely, a tooth of the external toothing engages in a tooth space of the internal toothing. In the engagement region, the internal toothing and the external toothing interact in a sealing manner.

On the other side of the engagement region, i.e. preferably on the side diametrically opposite the engagement region with respect to the first axis of rotation and/or the second axis of rotation, the filler piece is arranged. The filler piece is present between the first gearwheel and the second gearwheel or, in other words, between the external toothing of the first gearwheel and the internal toothing of the second gearwheel. The filler piece is thus arranged in a fluid space which is bounded radially inwards by the first gearwheel and radially outwards by the second gearwheel, in each case with respect to the first axis of rotation and the second axis of rotation respectively.

The filler piece abuts the external toothing on the one hand and the internal toothing on the other. More precisely, the filler piece lies sealingly against tooth tips of the external toothing and sealingly against tooth tips of the internal toothing in order to divide the fluid space into the first fluid chamber and the second fluid chamber. Each of the two fluid chambers is thus bounded in the circumferential direction on the one hand by the filler piece and on the other hand by the tight interlocking of the external toothing and the internal toothing in the engagement region.

Depending on a direction of rotation of the internal gear fluid machine, one of the fluid chambers serves as a suction chamber and the other of the fluid chambers serves as a pressure chamber. If the internal gear fluid machine is designed as a pump or is operated as a pump, fluid is supplied to the respective suction chamber, which conveys the internal gear fluid machine in the direction of the pressure chamber or into the pressure chamber. Accordingly, the suction chamber can also be referred to as the inlet chamber and the pressure chamber as the outlet chamber; the decisive factor is that the fluid is always conveyed from the inlet chamber towards the outlet chamber during operation of the internal gear fluid machine. The pressure present in the inlet chamber is always lower than the pressure in the outlet chamber when operating as a pump. Of course, however, the pressure in the inlet chamber can already be (significantly) higher than an ambient pressure. For example, with the help of the internal gear fluid machine, fluid under pressure is conveyed from the inlet chamber towards the outlet chamber.

If, on the other hand, the internal gear fluid machine is in the form of a motor or is operated as a motor, fluid is supplied to the pressure chamber and enters the suction chamber by causing the gearwheels to rotate. In this case, the pressure chamber is an inlet chamber and the suction chamber is an outlet chamber; the pressure in the inlet chamber is higher than the pressure in the outlet chamber. In the context of this description, the operation of the internal gear fluid machine as a motor is not explicitly discussed, but the internal gear fluid machine and its function are explained for operation as a pump. However, it is of course also possible to use the internal gear fluid machine as a motor, and the explanations are analogously applicable to such an internal gear fluid machine design or use.

Basically, it should be noted that in the context of this application, the suction chamber can also be referred to as a low-pressure chamber and the pressure chamber can also be referred to as a high-pressure chamber. Analogously, the suction side of the internal gear machine corresponds to a low-pressure side and the pressure side to a high-pressure side. The terms "low pressure" and "high pressure" are not to be understood as a restriction to a certain pressure level; rather, the pressure in the high-pressure chamber or on the high-pressure side is higher than the pressure in the low-pressure chamber or on the low-pressure side.

Preferably, the filler piece is made of several parts and thus has several segments. The segments of the filler piece are arranged next to each other in the radial direction, so that a first segment is arranged on the side of a second segment facing the first gearwheel and, conversely, the second segment is arranged on the side of the first segment facing the second gearwheel. The first segment is in sealing contact with the first gearwheel or its external toothing and the second segment is in sealing contact with the second gearwheel or the internal toothing of the second gearwheel.

The two segments can preferably be displaced against each other in the radial direction. Particularly preferably, a gap between them is subjected to fluid pressure during operation of the internal gear fluid machine in such a way that the first segment is forced in the direction of the first gearwheel and the second segment in the direction of the second gearwheel, so that the segments are in sealing contact with the respective gearwheel or the tooth heads of the corresponding toothing. The internal gear fluid machine is thus radially compensated or gap compensated in the radial direction. Each of the segments can be further subdivided into segments. For example, the first segment is in one piece or consists of at least two segments and/or the second segment is in one piece or consists of at least two segments. These segments of the filler piece are also preferably mounted so that they can be displaced in relation to each other, i.e. they can be displaced independently of each other. This achieves a particularly effective gap compensation.

The internal gear fluid machine has the machine housing. The two gearwheels of the internal gear fluid machine are arranged between housing walls of the machine housing. Thus, one of the housing walls is present on a first side of the gearwheels and a second of the housing walls is present on a side of the gearwheels opposite to the first side in the axial direction, such that the housing walls receive the gearwheels between them when viewed in the axial direction. In particular, a gap remaining between the housing walls and the gearwheels is dimensioned so small that the housing walls provide a sufficient seal of the fluid space or fluid chambers. For example, the gearwheels are mounted on and/or in the machine housing.

The second gearwheel is surrounded in the circumferential direction by at least one bearing recess formed in the machine housing. The bearing recess is designed in such a way that it at least partially, in particular only partially, overlaps the second gearwheel in the axial direction and is in particular arranged to completely overlap the second gearwheel. The bearing recess thus not only has a smaller extension in the axial direction than the second gearwheel, but is also arranged in such a way that the ends bounding the bearing recess in the axial direction are arranged to overlap the second gearwheel as seen in the axial direction. The bearing recess therefore does not project beyond the second gearwheel in the axial direction.

For example, the bearing recess is in the form of a groove or channel formed in the machine housing and extending in the circumferential direction. In such an embodiment, the bearing recess surrounds the second gearwheel in the circumferential direction by at least 30°, at least 60°, at least 90°, at least 120° or at least 150°. However, the bearing recess can also be significantly smaller in the circumferential direction and surround the second gearwheel in this direction by less than 30°, in particular by at most 15°, at most 10° or at most 5°. In this case, the bearing recess is designed as a round bore, for example.

The bearing recess serves to form the hydrostatic bearing or a hydrostatic bearing for the second gearwheel. During operation of the internal gear fluid machine, the bearing recesses are at least temporarily pressurised with fluid so that the second gearwheel is forced away from the machine housing in the radial direction. This creates a fluid film between the second gearwheel and the machine housing, which results in a particularly loss-free bearing of the second gearwheel. In particular, the pressure present in the bearing recess counteracts the pressure present in the pressure chamber. The bearing recess is arranged and/or designed accordingly for this purpose.

Thus, while the fluid present in the pressure chamber forces the second gearwheel in a first direction, the fluid present in the bearing recess forces the second gearwheel in a second direction opposite to the first direction. Particularly preferably, a force exerted on the second gearwheel by the fluid present in the bearing recess is at least as great as a force exerted on the second gearwheel by the fluid present in the pressure chamber. For example, the former force is at least 50%, at least 60%, at least 70%, at least 80% or at least 90% of the latter force.

The bearing recess is fluidically connected to one of the fluid connections for admission of the pressurised fluid to the bearing recess. Flow resistance is present between the fluid connection and the bearing recess, which causes a reduction in pressure. The flow resistance is preferably in the form of a cross-sectional constriction. Preferably, a flow cross-sectional area is identical in terms of flow before and after the flow resistance or cross-sectional constriction. This means that the cross-sectional constriction is only present in sections, in particular it does not extend directly to the bearing recesses. Rather, the cross-sectional area of flow decreases in the area of the cross-sectional constriction and then increases again, in particular also in the area of the cross-sectional constriction. For example, a ratio between a length and a width or a diameter of the cross-sectional constriction is at most 25, at most 20 or at most 15. Preferably, however, the ratio is at most 10 or at most 5. The width or the diameter is to be understood as the smallest dimension of the cross-sectional constriction over its extension.

By means of the flow resistance, fluid loss from the bearing recess in the direction of a return flow is reduced. The flow resistance can be readily provided, as usually the pressure of the fluid available on the pressure side of the internal gear fluid machine is more than sufficient to achieve adequate bearing. It is therefore possible to reduce the pressure without degrading the quality of the bearing. The reduction of the pressure in turn causes a reduction of the flow, so that a smaller amount of fluid is discharged via the bearing recesses in the direction of the return or into the return.

Preferably, the flow resistance is designed in such a way that the amount of fluid discharged from the bearing recess into the return per unit time corresponds to at most 50%, at most 40%, at most 30% or at most 25% of the total amount of fluid per unit time occurring in the return. Such a dimensioning of the flow resistance is in any case suitable to realise a sufficient bearing of the second gearwheel in the machine housing. Of course, the amount of fluid per unit time can also be higher and correspond, for example, to at most 75%, at most 70%, at most 75%, at most 60% or at most 55% of the aforementioned size. However, the smaller values are preferred, because with these the fluid loss can be significantly limited with sufficient quality of the bearing.

For example, dimensions of the flow resistance, in particular a smallest flow cross-sectional area of the flow resistance, are dependent on a diameter of the second gearwheel or a root circle diameter of the internal toothing. It may be provided that the dimensions are selected as a function of an extension of the bearing recess in the circumferential direction and/or in the axial direction. Additionally or alternatively, a dependence on the bearing clearance and/or on an extension of the bearing lands in axial direction may be provided. For example, a relationship with a displacement volume of the internal gear fluid machine is also provided. In particular, a ratio of the dimensions of the flow resistance, in particular of a smallest diameter of the flow resistance over its extension, to the displacement volume of at least 15 l/m2 and at most 75 l/m2, at least 30 l/m2 and at most 60 l/m2 or at least 30 l/m2 and at most 45 l/m2 is provided. This results in dimensions of 0.12 mm to 0.16 mm for an internal gear fluid machine with a displacement volume of 8 $cm^3$. These values apply in particular to a design of the flow resistance as an orifice.

Particularly preferably, the bearing recess is fluidically connected to both fluid connections, in particular via a flow resistance in each case. This ensures that the hydrostatic bearing is provided independently of the direction of rotation of the internal gear fluid machine and independently of operation as a pump or as a motor. The flow resistance is identical for both fluid connections. Alternatively, however, an asymmetrical design can be realised in which different flow resistances exist between the fluid connections and the bearing recesses.

It can be provided that the bearing recess completely surrounds the second gearwheel in the circumferential direction. Preferably, however, it only partially surrounds the second gearwheel in the circumferential direction. Particularly preferably, there are two bearing recesses spaced apart from each other in the circumferential direction, i.e. the two bearing recesses are spaced apart from each other on both sides in the circumferential direction. In particular, the bearing recesses, seen in cross-section, are arranged symmetrically with respect to an imaginary plane which accommodates the axis of rotation of the second gearwheel and/or the axis of rotation of the second gearwheel. For example, the bearing recesses are fluidically connected to different fluid connections, preferably each via a flow resistance. In other words, a first one of the bearing recesses is fluidically connected to a first fluid connection via a first flow resistance and a second one of the bearing recesses is fluidically connected to a second fluid connection of the internal gear fluid machine via a second flow resistance.

This means that each of the bearing recesses is directly connected to the corresponding fluid connection via the respective flow resistance and is only indirectly in flow connection with the respective other fluid connection, in particular via the fluid space or one or more of the fluid chambers. Of course, such a flow connection can also exist outside the internal gear fluid machine. Depending on the direction of rotation of the internal gear fluid machine, one of the bearing recesses is always fluidically connected to the pressure side and another of the bearing recesses to the suction side of the internal gear fluid machine. This achieves a balance of forces within the internal gear fluid machine, resulting in particularly high efficiency.

The flow resistance is arranged in the fluid line via which the respective bearing recess is in fluid connection with the corresponding fluid connection. For example, the bearing recesses are each connected to the corresponding fluid connection via a fluid line, whereby a flow resistance is arranged in each of the fluid lines. All embodiments relating to the bearing recess within the scope of this description are preferably optionally applicable to each of the plurality of bearing recesses, if present.

It may be envisaged that only a single bearing recess is formed in the machine housing, which only partially or completely surrounds the second gearwheel in the circumferential direction. This bearing recess is fluidically connected to the fluid connection of the internal gear fluid machine. Alternatively, it can also be provided that the single bearing recess is fluidically connected to several fluid connections, in particular to a fluid connection of the pressure side and a fluid connection of the suction side of the internal gear fluid machine. For example, valves, in particular non-return valves, are present in terms of flow between the bearing recess on the one hand and the fluid connections on the other. These are preferably designed and/or set in such a way that they only allow a flow of fluid from the direction of the respective fluid connection in the direction of the bearing recess, i.e. they prevent a flow from the bearing recess in the direction of the fluid connections. In this way, an optimal admission of the fluid to the bearing recess is always achieved, but a loss of fluid or an overflow of the fluid from the pressure side to the suction side via the bearing recess is largely avoided.

In the axial direction, the bearing recess only partially overlaps the second gearwheel so that, conversely, the second gearwheel completely overlaps the bearing recess in the axial direction. For example, the bearing recess is bounded in the axial direction on both sides by bearing webs which are formed in the circumferential direction to overlap the bearing recess and have at least the same extension as the bearing recess. In the case of multiple bearing recesses, each of the bearing recesses has such bearing webs. The second gearwheel lies against the bearing recesses in a sealing manner, in particular continuously in the circumferential direction in overlapping with the bearing recesses, or the second gearwheel has a smaller distance from the bearing recesses than from a bottom of the bearing recess which bounds the bearing recess in the direction facing away from the second gearwheel, in particular in the radial direction outwards. This reliably prevents an undesired outflow of fluid from the bearing recess. For example, the second gearwheel has a bearing clearance, i.e. a distance in the radial direction from the bearing webs, of at most 0.25 mm, at most 0.2 mm, at most 0.15 mm, at most 0.1 mm, at most 0.075 mm or at most 0.05 mm. Preferred are the distances of at most 0.1 mm and less.

The described internal gear fluid machine enables a particularly effective and loss-free mounting of the second gearwheel in the machine housing. At the same time, excessive fluid losses, which can occur due to the use of the fluid to realise the hydrostatic bearing, are effectively avoided due to the flow resistance. The flow resistance does cause a pressure loss between the fluid connection and the bearing recess, so that the pressure of the fluid present in the bearing recess is lower than the pressure of the fluid at the fluid connection. However, the fluid pressure remaining in the bearing recess is sufficient to support the second gearwheel. Preferably, the flow resistance is designed or dimensioned accordingly.

Regardless of the design of the internal gear fluid machine, it may be provided that the internal gear fluid machine is fluidically connected on the one hand to a first chamber of a working cylinder and on the other hand to a second chamber of the working cylinder. In other words, the first chamber of the working cylinder is fluidically connected to a first of the fluid chambers and the second chamber of the working cylinder is fluidically connected to a second of the fluid chambers. Accordingly, by means of the internal gear fluid machine, either mechanical energy can be converted into a force acting on a working piston arranged in the working cylinder or a force acting on the working piston can be converted into mechanical energy. Of course, it can be provided here that the arrangement consisting of the internal gear fluid machine in the working cylinder is operated at times for converting the mechanical energy into the force and at times for converting the force into the mechanical energy. The working cylinder is preferably designed as a hydraulic cylinder; in this case a fluid, in particular oil, is used as fluid. The arrangement of internal gear fluid machine and working cylinder is, for example, a component of an industrial truck, in particular a forklift truck, or of a construction machine or of a construction implement, in particular an excavator. In this respect, the invention also relates to such an arrangement of an internal gear fluid machine and a working cylinder, as well as to a method for operating such an arrangement. Additional reference is made to the further explanations within the scope of this description.

A further development of the invention provides that the flow resistance is in the form of a fluidic orifice, a fluidic throttle or a fluidic nozzle. An orifice plate is to be understood as a sudden cross-sectional constriction, i.e. at the beginning of the orifice plate the cross-sectional area of flow decreases abruptly and at the end of the orifice plate expands again just as abruptly, in particular to the same cross-sectional area of flow as before the orifice plate. For example, the orifice has a ratio of the length of the cross-sectional constriction in the direction of flow to the width or diameter of at most 2, at most 1.5 or at most 1. The same applies to the orifice, with the difference that the ratio of length to width or diameter is greater. In particular, the ratio is at least 2 or greater than 2. For example, a ratio of at least 3, at least 4 or at least 5 is used.

The nozzle is a cross-sectional constriction in which the flow cross-sectional area continuously decreases until it reaches a minimum. Downstream of the minimum flow cross-sectional area, the flow cross-sectional area expands again. This can happen suddenly or continuously. In the latter case, the flow resistance has a diffuser in addition to the nozzle. For example, the nozzle and the diffuser are symmetrical or mirror images of each other, i.e. they have the same longitudinal extension and the same gradient of the cross-sectional area of flow over the longitudinal extension. The use of the nozzle and the diffuser enables an effective reduction of the pressure or flow rate without excessive losses.

A further development of the invention provides that the fluid line extends radially outwards from the bearing recess and/or is straight throughout. The fluid line opens directly into the bearing recess. On its side facing away from the bearing recess, the fluid line can also open directly into the fluid connection or alternatively be only indirectly connected to it in terms of flow via a further line. Irrespective of this, the fluid line runs from the bearing recess in a radial direction outwards, preferably exactly in a radial direction. This means that a longitudinal centre axis of the fluid line is perpendicular to an imaginary plane containing the axis of rotation of the first gearwheel and the axis of rotation of the second gearwheel. This realises a low-loss introduction of the fluid into the bearing recess. Additionally or alternatively, the fluid line is straight throughout. This means in particular that the longitudinal centre axis of the fluid line is straight throughout. The straight course ensures a low pressure loss across the fluid line, so that this design also serves to introduce the fluid into the bearing recess with high efficiency.

A further development of the invention provides that the fluid line opens radially inwards into the bearing recess by passing through a bottom of the bearing recess to form a muzzle opening. The bottom delimits the bearing recess in the direction away from the second gearwheel. The bottom is formed by the machine housing. The bearing recess is thus bounded by the base in the radially outward direction and is open in the radially inward direction and correspondingly in the direction of the second gearwheel. In the axial direction, the bearing recess is preferably bounded on opposite sides by walls which run at an angle to the base. The walls delimiting the bearing recess preferably run parallel to each other. Alternatively, however, they can also be angled towards each other so that, for example, the bearing recess has an axial extension that increases or decreases in the direction of the second gearwheel or in the direction facing away from the floor. In this case, the bearing recess is trapezoidal in section, for example. The fluid line passes through the bottom of the bearing recess. In this case, it forms the muzzle opening. In other words, the fluid line opens into the bearing recess via the muzzle opening, the muzzle opening being formed in the bottom. Such a design also serves to efficiently introduce the fluid into the bearing recess and to avoid excessive pressure losses.

A further development of the invention provides that the fluid line on its side facing away from the bearing recess opens into a dimensionally larger connection channel via which it is fluidically connected to the fluid connection. It has already been pointed out that the fluid line can either be connected directly or only indirectly to the fluid connection. In the case of only indirect connection of the fluid line to the fluid connection, the fluid line is in flow connection with the fluid connection via the connection channel. For this purpose, the fluid line opens directly into the connection channel, namely in particular in the radial direction. A longitudinal central axis of the fluid line is preferably angled with respect to a longitudinal central axis of the connection channel, i.e. the two longitudinal central axes form an angle with each other that is greater than 0° and less than 180°. Preferably, the angle is at least 45° and at most 135°, at least 60° and at most 120°, at least 75° and at most 105° or approximately or exactly 90°.

In principle, the connection channel can be straight throughout, i.e. it can be straight throughout between the point at which the fluid line opens into it and the fluid connection. However, the connection channel can also have at least one bend or curvature. Preferably, however, the fluid line opens into a straight section of the connection channel. The connection channel opens into the fluid connection on its side facing away from the fluid line, i.e. it is directly connected to the fluid line in terms of flow. For example, the connection channel opens into the fluid connection in a radial direction so that the longitudinal centre axis of the connection channel is angled relative to a longitudinal centre axis of the fluid connection. Please refer to the explanations above regarding the angle.

The connection channel has larger dimensions than the fluid line, in particular its flow cross-section is larger than a flow cross-section of the fluid line. This results in a particularly low pressure loss, so that the fluid line is connected to the fluid connection in a particularly effective manner in terms of flow. For example, the largest cross-sectional flow area of the connection channel over its extension is larger than the largest cross-sectional flow area of the fluid conduit over its extension by a factor of at least 2, at least 3, at least 4 or at least 5.

A further development of the invention provides that the cross-sectional constriction is formed only locally in the fluid line, so that a flow cross-section of the fluid line on both sides of the cross-sectional constriction is larger than a flow cross-section in the region of the cross-sectional constriction. The cross-sectional constriction is present in the fluid line and temporarily reduces its cross-sectional flow area. This means that the fluid line as a whole cannot be considered a cross-sectional constriction, even though its cross-sectional flow area may be smaller than the cross-sectional flow area of elements that fluidically connect to the fluid line. For example, the cross-sectional flow area of the connection channel may be larger than that of the fluid line.

Nevertheless, the fluid line itself is not the flow resistance, but the cross-sectional constriction is present in the fluid line.

On both sides of the cross-sectional constriction, the fluid line has a flow cross-sectional area that is larger than the flow cross-sectional area of the cross-sectional constriction or flow resistance. For example, the cross-sectional flow area of the fluid line on both sides of the cross-sectional constriction is larger than the cross-sectional flow area of the cross-sectional constriction by a factor of at least 5, at least 7.5, at least 10, at least 12.5, at least 15 or at least 20. The cross-sectional flow area of the cross-sectional constriction is understood to be the smallest cross-sectional flow area of the cross-sectional constriction over its length. The described design provides an effective flow restriction for the fluid.

A further development of the invention provides that the bearing recess is fluidically connected on its side facing away from the fluid line via a leakage gap to a return recess of the internal gear fluid machine, which is in fluidic connection with a suction side of the internal gear fluid machine directly and/or a fluid tank. The bearing recess is fluidically connected to a return flow of the internal gear fluid machine, via which fluid is discharged, namely in the direction of the suction side of the internal gear fluid machine and/or in the direction of the fluid tank. The return line collects leakage fluid, i.e. fluid that accumulates in the internal gear fluid machine due to leakage. The fluid is discharged in the direction of the suction side and/or the fluid tank, preferably in such a way that it is conveyed again from the internal gear fluid machine in the direction of the pressure side. For example, the fluid tank is fluidically connected to the suction side of the internal gear fluid machine for this purpose. The fluid tank can be part of the internal gear fluid machine or separate from it. For example, the internal gear fluid machine and the fluid tank are part of a corresponding arrangement.

The return flow has the return flow recess formed in the machine housing. For example, the return recess is a recess formed in the machine housing and open in the direction of the gearwheels. The return recess can have at least the same dimensions in the axial direction as the at least one bearing recess or the bearing recesses or project beyond them in the axial direction, in particular only on one side or on both sides. The bearing recess or the bearing recesses are each formed at a distance from the return recess in the circumferential direction. If there are several bearing recesses, the return or the return recess is preferably arranged in the circumferential direction between the bearing recesses. In particular, the bearing recesses are arranged at the same distance from the return recess in the circumferential direction.

The return flow is preferably designed in such a way that the fluid in it is either fed to the fluid tank and/or directly to the internal gear fluid machine again and conveyed by it in the direction of its pressure side. The fluid discharged from the return into the fluid tank can also be fed again to the internal gear machine. In other words, the fluid is first discharged from the return into the fluid tank and then taken out of the fluid tank by the internal gear fluid machine and conveyed towards its pressure side.

As explained above, the bearing recess is preferably spaced from the return recess in the circumferential direction. Alternatively, however, it can also be provided that the bearing recess, viewed in the circumferential direction, is connected to the return flow or the return flow recess at exactly one point, in particular it opens into the return flow recess.

Between the bearing recess and the return recess there is the leakage gap, in the region of which the second gearwheel is only a small distance from the machine housing in the radial direction, at least in some regions, for example a distance of at most 10 μm, at most 5 μm, at most 2.5 μm or at most 1 μm. In this respect, only a small amount of fluid passes from the bearing recess into the return recess via the leakage gap. In particular, this gap, seen in the circumferential direction, is only present at one point or over a certain part of the second gearwheel. Away from this point or part, the distance is greater. In particular, the small distance, seen in cross-section, is present on a side of the internal gear machine on which there is a higher pressure. On the other hand, the distance is greater on a side with lower pressure. For example, the distance away from the location or part of the second gearwheel, in particular on the side with lower pressure, is more than 10 μm, in particular at least 25 μm, at least 50 μm, at least 75 μm or at least 100 μm. Particularly preferably, however, the distance there is at most 150 μm, at most 125 μm or at most 100 μm.

The return or the return recess is centred in relation to the filler piece, for example, as seen in the circumferential direction. This means that it is formed centrally between the pressure side and the suction side of the internal gear fluid machine, so that the latter is ultimately symmetrical. The realisation of the return recess enables an effective return of the leakage fluid accumulating in the internal gear fluid machine.

A further development of the invention provides that the return flow has return pockets in the axial direction on both sides of the gearwheels, which are in flow connection with the return flow recess. The return pockets are also in the form of recesses formed in the machine housing. Seen in the axial direction, one such return pocket is present or formed on each side of the gearwheels. The return pockets also serve to return leakage fluid accumulating in the internal gear fluid machine in the direction of the suction side of the internal gear fluid machine and/or in the direction of the fluid tank. This realises an efficient operation of the internal gear fluid machine.

A further development of the invention provides that an interface channel is formed in each of the two housing walls and that the same fluid chamber is in fluid connection with the fluid connection of the internal gear fluid machine via both interface channels. There is an interface channel in each of the housing walls. This means that each of the housing walls has such an interface channel. Via the interface channels, one of the fluid chambers is fluidically connected to a fluid connection of the internal gear fluid machine, preferably permanently. Each of the interface channels is thus fluidically present between this fluid chamber and this fluid connection, so that the flow connection between the fluid chamber and the fluid connection runs via both interface channels. The interface channels are fluidically parallel between the fluid chamber and the fluid connection, so that fluid can flow via both interface channels simultaneously from the fluid connection to the fluid chamber or vice versa.

It is therefore not intended to use the interface channels to connect different fluid chambers to the same fluid connection or to connect one of the fluid chambers to different fluid connections. Rather, the interface channels serve to establish the flow connection between exactly one of the fluid chambers and exactly one of the fluid connections. Accordingly, during operation of the internal gear fluid machine, the fluid flows simultaneously either out or in through the interface channels. In this way, a particularly high fluid throughput of the internal gear fluid machine can be achieved. Moreover, the flow connection is to be understood as a flow connection that runs exclusively via the internal gear fluid machine, i.e. not via an external connection. In particular, the flow connection only runs via the interface channels and—optionally—via one or more axial openings in one or more optionally provided sealing discs.

In principle, it can be provided that the fluid chamber which is fluidically connected to the fluid connection via the interface channels is the first fluid chamber or the second fluid chamber. Accordingly, the fluid chamber can be either the suction chamber or the pressure chamber, so that the interface channels serve either to feed fluid into the suction chamber or to discharge fluid from the pressure chamber during operation of the internal gear fluid machine. In either case, a particularly low flow resistance is achieved when the fluid flows in or out.

A further development of the invention provides that in the axial direction with respect to the first axis of rotation, next to the first gearwheel and the second gearwheel, a sealing disc is arranged which, during operation of the internal gear fluid machine, bears in a sealing manner against the first gearwheel and the second gearwheel, an axial aperture being formed in the sealing disc, via which one of the fluid chambers is in fluid connection with one of the fluid connections of the internal gear fluid machine. For example, seen in the axial direction, the sealing disc is only present on one side of the first gearwheel and the second gearwheel. Preferably, however, it is provided that—again seen in axial direction—such a sealing disc is arranged on both sides of each of the two gearwheels. In the context of this description, the particularly advantageous case of having several sealing discs is often explained. However, it goes without saying that the corresponding explanations can also be used for a design of the internal gear fluid machine in which only one sealing disc is part of the internal gear fluid machine.

The sealing disc is located on one side of the gearwheels as seen in the axial direction. During operation of the internal gear fluid machine, the sealing disc is in sealing contact with the gearwheels. For this purpose, it is preferably pressed in the axial direction towards the gearwheels, for example by pressurisation, i.e. by the application of a pressurised fluid. If there are several sealing discs, they are arranged on both sides of the gearwheels in the axial direction. One of the sealing discs is thus present on a first side of the gearwheels and a second of the sealing discs is present on a second side of the gearwheels opposite the first side in the axial direction, so that the sealing discs receive the gearwheels between them as seen in the axial direction. During operation of the internal gear fluid machine, the sealing discs are in sealing contact with the gearwheels. Preferably, they are pressed in the axial direction towards the gearwheels, for example, by pressurisation, i.e. by applying a pressurised fluid. The internal gear fluid machine is thus axially compensated or gap compensated in the axial direction. This achieves a particularly high efficiency of the internal gear fluid machine.

The axial opening is formed in the sealing disc. If there are several sealing discs, an axial opening is formed in each of the sealing discs. In other words, each of the sealing discs has one such axial aperture, so that a total of several axial apertures are formed in the several sealing discs. One of the fluid chambers is fluidically connected, preferably permanently, to a fluid connection of the internal gear fluid machine via the axial aperture or apertures. From a fluidic point of view, the axial opening or each of the axial openings is therefore located between this fluid chamber and this fluid connection, so that the flow connection between the fluid chamber and the fluid connection runs via the axial opening or openings.

It is therefore not intended to connect different fluid chambers to the same fluid connection via the axial opening or the axial openings or to connect one of the fluid chambers to different fluid connections. Rather, the axial opening or the axial openings serve to establish the flow connection between exactly one of the fluid chambers and exactly one of the fluid connections. Accordingly, during operation of the internal gear fluid machine, the fluid flows either out or in through the axial aperture or simultaneously through the axial apertures. In this way, a particularly high fluid throughput of the internal gear fluid machine can be achieved.

In principle, it can be provided that the fluid chamber which is fluidically connected to the fluid connection via the axial aperture or apertures is the first fluid chamber or the second fluid chamber. Accordingly, the fluid chamber can be either the suction chamber or the pressure chamber, so that the axial aperture or apertures serve either to feed fluid into the suction chamber or to discharge fluid from the pressure chamber during operation of the internal gear fluid machine. In either case, a particularly low flow resistance is achieved when the fluid flows in or out.

A further development of the invention provides that at least one of the interface channels is fluidically connected to the fluid chamber via the axial opening. In other words, the axial opening is fluidically located between the interface channel and the fluid chamber. Accordingly, the fluid chamber is fluidically connected to the fluid connection via the axial opening and the corresponding interface channel. Particularly preferably, of course, both interface channels are fluidically connected to the fluid chamber via the axial apertures. This means that a first of the interface channels is fluidically connected to the fluid chamber via a first of the axial apertures. In addition, a second of the interface channels is in fluidic connection with the same fluid chamber via a second of the axial openings. In total, therefore, a plurality of flow paths are present between the fluid chamber and the fluid connection, a first of the flow paths extending via the first axial aperture and the first interface channel and a second of the flow paths extending via the second axial aperture and the second interface channel.

In a further development of the invention, the axial aperture widens towards the first gearwheel and the second gearwheel. A flow cross-sectional area of the axial opening does not remain constant over its respective extension, but rather changes. In this case, the flow cross-sectional area of the axial opening increases in the direction of the gearwheels, i.e. it becomes larger. For example, the expansion takes place continuously, at least in sections or throughout, so that discontinuities in the flow cross-sectional area are avoided. However, the widening can also take place abruptly, so that a dimensional jump is formed in the axial opening. Preferably, the axial opening is round, i.e. circular, in cross-section with respect to its respective longitudinal extension. The widening of the axial opening enables a particularly efficient inflow or outflow of the fluid. Particularly preferably, the widening is carried out for both axial openings. In this respect, it is provided that the axial openings expand in the direction of the first gearwheel and the second gearwheel respectively. The explanations for widening the axial aperture can be used as a supplement in each case.

A further development of the invention provides that the fluid connection is a first fluid connection of several fluid connections and that the first fluid chamber is in flow order with the fluid connection present as the first fluid connection via the interface channels present as first connection channels, and that a second interface channel is formed in each of the housing walls and the second fluid chamber is in flow connection with a second fluid connection of the internal gear fluid machine via the second connection channels. In total, the internal gear fluid machine therefore has several fluid connections, several first interface channels and several second interface channels. The aforementioned fluid connection forms the first fluid connection and the aforementioned interface channels form the first interface channels.

In addition to the first fluid connection, the second fluid connection and in addition to the first interface channels, the second interface channels are now present in the machine housing. The second fluid chamber is fluidically connected to the second fluid connection, preferably permanently, via the second interface channels. The further explanations in the context of this description with regard to the first interface channels can be applied analogously to the second interface channels.

It is particularly preferred that the filler piece extends in the circumferential direction from the first interface channels to the second interface channels, i.e. engages both in the imaginary extension of the first interface channels and in the imaginary extension of the second interface channels. Furthermore, the described taper is particularly preferably provided and formed both on the side of the filler piece facing the first interface channels and on the side facing the second interface channels. In particular, the described embodiment enables a direction-independent operation of the internal gear fluid machine.

In addition or alternatively, the above explanations apply to the interface channels for the axial aperture or apertures. It can thus be provided that the fluid connection is a first fluid connection of several fluid connections and that the first fluid chamber is in flow order with the fluid connection present as the first fluid connection via the axial opening formed as the first axial opening, and that a second axial opening is formed in the sealing disc and the second fluid chamber is in flow connection with a second fluid connection of the internal gear fluid machine via the secand axial opening. Of course, several sealing discs with correspondingly several axial openings are particularly preferred, whereby the axial openings are formed as first axial openings. In such a design, a second axial opening is formed in each of the sealing discs, whereby the second fluid chamber is in flow order with the second fluid connection via the second axial openings.

A further development of the invention provides that the filler piece projects in the circumferential direction as far as the axial opening and/or, viewed in the circumferential direction, ends in overlapping with the axial opening. The filler piece thus projects in the circumferential direction as far as an imaginary extension of the axial opening. At least it engages in this imaginary extension, but it can also pass completely through it in the circumferential direction. Particularly preferably, however, the filler piece, viewed in the circumferential direction, ends in overlap with the axial opening, i.e. in the imaginary extension of the axial opening. This achieves a reliable and effective sealing of the fluid chambers against each other by means of the filler piece. It should also be noted at this point that such a design preferably applies to several axial openings. It is thus provided, for example, that the filler piece projects in the circumferential direction as far as the axial apertures and/or, viewed in the circumferential direction, ends in overlapping with the axial apertures.

A further development of the invention provides that the filler piece is tapered in the axial direction in overlapping with the axial aperture, in particular only on one side or on both sides. It is particularly preferred that the taper of the filler piece, viewed in the circumferential direction, ends in overlap with the axial apertures. The taper of the filler piece causes the filler piece to move away from the axial aperture or at least one of the axial apertures in the axial direction, i.e. to be continuous therewith. In other words, the distance between the filler piece and the axial opening or at least one of the axial openings increases in the circumferential direction. This facilitates the inflow or outflow of the fluid.

In addition, the taper of the filler piece can be designed in such a way that the fluid is deflected in the circumferential direction in an efficient manner, so that it can flow into or out of the respective fluid chamber particularly efficiently. It can be provided that the filler piece is only tapered on one side, i.e. on its side facing the axial aperture or one of the axial apertures. However, it is particularly preferred that it is tapered on both sides so that the inflow or outflow through the axial opening or both axial openings can take place efficiently. Particularly preferably, the filler piece is symmetrical when viewed in longitudinal section, i.e. in the axial direction, so that the taper on both sides is identical, although mirror-inverted.

A further development of the invention provides that the taper of the filler piece, viewed in the circumferential direction, ends in overlap with the axial aperture or apertures. The filler piece extends at least in some areas up to the axial opening or openings and preferably has constant dimensions in the axial direction, as seen in the circumferential direction up to the taper. For example, the filler piece has an extension in the axial direction up to the imaginary extension of the axial opening or the axial openings, which corresponds to the distance of the sealing discs from each other, so that it rests against the sealing discs away from the axial opening or the axial openings, in particular continuously in the circumferential direction. Only then, i.e. in overlapping with the axial opening or openings, does the filler piece taper so that its extension in the axial direction decreases in the circumferential direction, namely up to a free end of the filler piece. In other words, the taper only begins to overlap with the axial opening or openings and preferably extends to the free end of the filler piece. This ensures a reliable sealing effect of the filler piece.

A further development of the invention provides that one of the connection channels is connected to the fluid connection directly and another of the connection channels is connected to the fluid connection via the connection channel overlapping the first gearwheel and the second gearwheel in the axial direction. For example, the interface channels have the same flow cross-sectional area. Preferably, at least one of the interface channels opens into the axial breakthrough, if present. Particularly preferably, both interface channels open into the optionally present multiple axial apertures.

For example, it may be provided that the flow cross-sectional area of the connection channel on its side facing the gearwheels and/or the respective axial aperture is smaller than the flow cross-sectional area of the axial aperture on its side facing the gearwheels and/or the respective interface channel. From the direction of the interface channel in the direction of the gearwheels and/or the axial breakthrough, the flow cross-section is widened and the flow cross-sectional area is correspondingly increased.

It can be provided that the interface channels have the same longitudinal extension in the axial direction with respect to their respective longitudinal centre axis. One of the interface channels is directly connected to the fluid connection in terms of flow, for example it opens directly into the fluid connection. The other of the connection channels is only indirectly connected to the fluid connection via the connection channel. The connection channel completely overlaps the two gearwheels in the axial direction.

In addition, it can be provided that the connection channel overlaps at least one of the sealing discs or both sealing discs, if these are present. It is thus provided, for example, that the connection channel opens into the interface channel on a side of a first of the sealing discs facing away from the gearwheels and into the fluid connection on a side of another of the sealing discs facing away from the gearwheels. For example, one interface channel opens into the fluid connection in the axial direction and the other interface channel opens into the fluid connection in the radial direction.

The fluid connection has a flow cross-sectional area that is larger than the flow cross-sectional area of the interface channels. For example, the cross-sectional flow area of the fluid connection is larger than the cross-sectional flow area of the interface channels by a factor of at least 2.5, at least 3, at least 4 or at least 5. Additionally or alternatively, the flow cross-sectional area of the connection channel is larger than the flow cross-sectional area of the connection channels, for example by a factor of at least 1.25, at least 1.5, at least 1.75 or at least 2.0. This ensures particularly effective operation of the internal gear fluid machine.

A further development of the invention provides that the axial opening is surrounded by a seal, which is in sealing contact on the one hand with the sealing disc and on the other hand with the machine housing, wherein a pressure field connected in terms of flow to a pressure side of the internal gear fluid machine is formed outside a region surrounded by the seal, so that the sealing disc is at least temporarily forced in the direction of the gearwheels. The seal ensures a fluid-tight connection between the axial passage or the respective axial passage and the respective interface channel.

Away from the seal, i.e. outside the area enclosed by the seal into which the axial opening and the interface channel open, the pressure field is present, which is at least temporarily subjected to pressurised fluid. For this purpose, the pressure field is fluidically connected to the pressure side of the internal gear fluid machine. The pressurised fluid forces the sealing disc in the direction of the gearwheels, so that the fluid chambers are reliably sealed from the axial disc in the axial direction. Particularly preferably, this applies to the multiple sealing discs, if present. It may thus be provided that the axial apertures are each embraced by a seal, which bears sealingly on the one hand against the respective sealing disc and on the other hand against the machine housing, wherein a pressure field fluidically connected to a pressure side of the internal gear fluid machine is formed outside a region embraced by the seal, so that the sealing disc is at least temporarily urged in the direction of the gearwheels.

A further development of the invention provides that the filler piece is formed symmetrically in the circumferential direction so that the internal gear fluid machine is reversible. This means that the filler piece is divided into several segments in the circumferential direction. Particularly preferably, the filler piece has a total of four segments, since it is divided into individual segments both in the radial direction and in the circumferential direction. In this way, the radial compensation of the internal gear fluid machine is realised independently of its direction of rotation. Such an internal gear fluid machine may also be referred to as a four-quadrant internal gear fluid machine or a reversible internal gear fluid machine.

According to a further development of the invention, the bearing recess is a first bearing recess of a plurality of bearing recesses and the flow resistance is a first flow resistance of a plurality of flow resistances, and a second one of the bearing recesses is formed in the machine housing spaced apart from the first bearing recess in the circumferential direction, which at least partially overlaps the second gearwheel in the axial direction, the first bearing recess being fluidically connected to the first fluid connection via the first flow resistance and the second bearing recess being fluidically connected to the second fluid connection via a second one of the flow resistances.

As already explained, there can be a further bearing recess in addition to the bearing recess. The bearing recess is referred to as the first bearing recess and the further bearing recess as the second bearing recess. The two bearing recesses, i.e. the first bearing recess and the second bearing recess, are arranged in the machine housing at a distance from each other in the circumferential direction. The explanations regarding the bearing recess or the first bearing recess are preferably fully applicable to the second bearing recess. Reference is therefore made to the corresponding explanations. Both bearing recesses are each fluidically connected to one of several fluid connections, namely the first bearing recess to the first fluid connection and the second bearing recess to the second fluid connection different from the first fluid connection. For example, the first fluid connection is on a pressure side and the second fluid connection is on a suction side of the internal gear fluid machine or vice versa.

In terms of flow, one of a plurality of flow resistances is present between the respective bearing recess and the respective fluid connection. The first flow resistance corresponds to the flow resistance already explained, the second flow resistance is present in addition to this. For the second flow resistance, the explanations on the first flow resistance can be used, so that reference is made to these. Preferably, the two bearing recesses are arranged symmetrically to each other and to the filler piece of the internal gear fluid machines. Accordingly, the internal gear fluid machines can each be operated efficiently in different directions of rotation.

A further development of the invention provides that the flow resistances are arranged symmetrically with respect to each other. This is to be understood as meaning that the flow resistances are symmetrically present in the machine housing and are symmetrically aligned. For example, the flow resistors are symmetrical with respect to an imaginary plane which contains both the first axis of rotation and the second axis of rotation. This achieves a simple and compact design of the internal gear fluid machine, which is also characterised by low flow losses and high efficiency.

Figure 2:
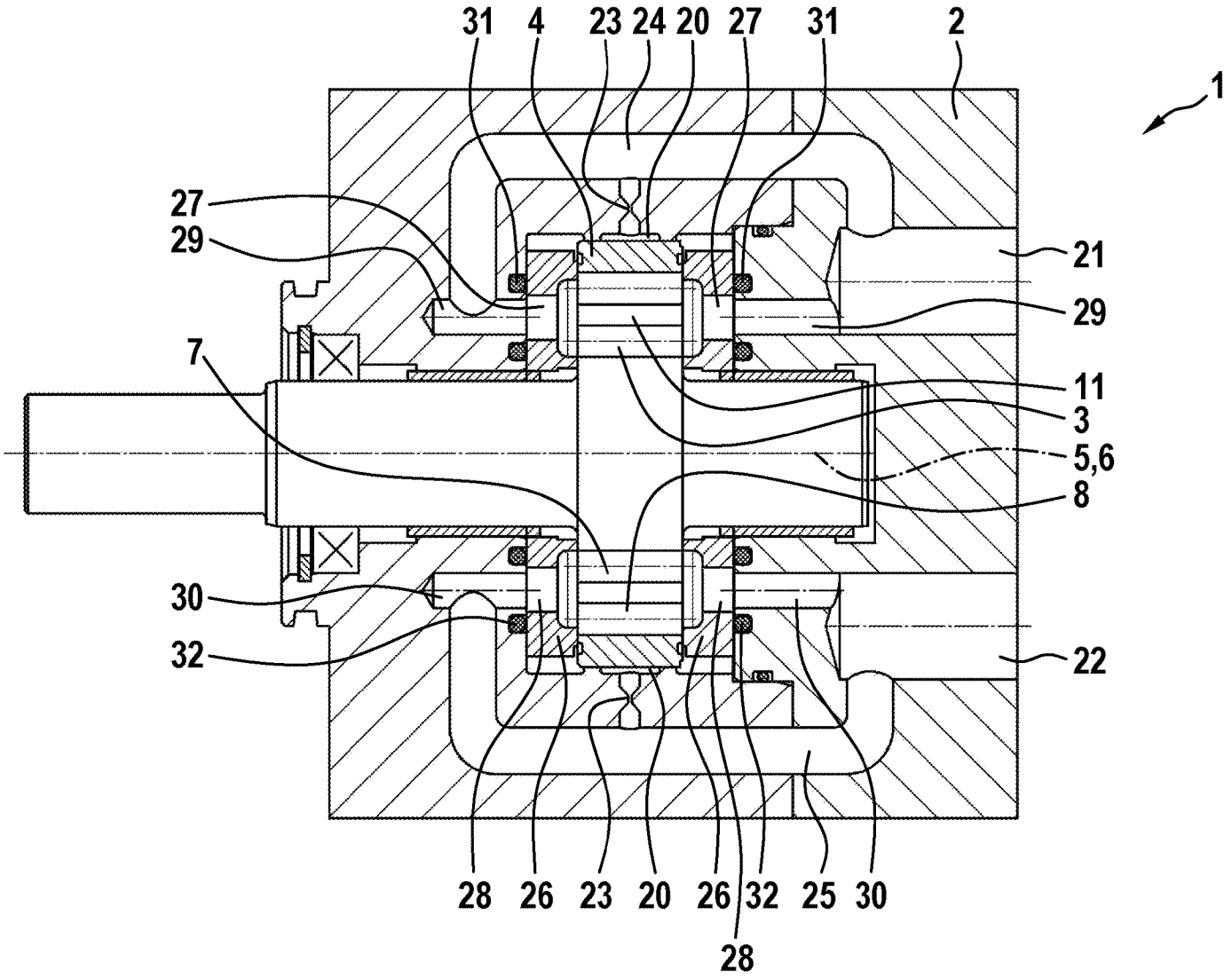
Figure 3:
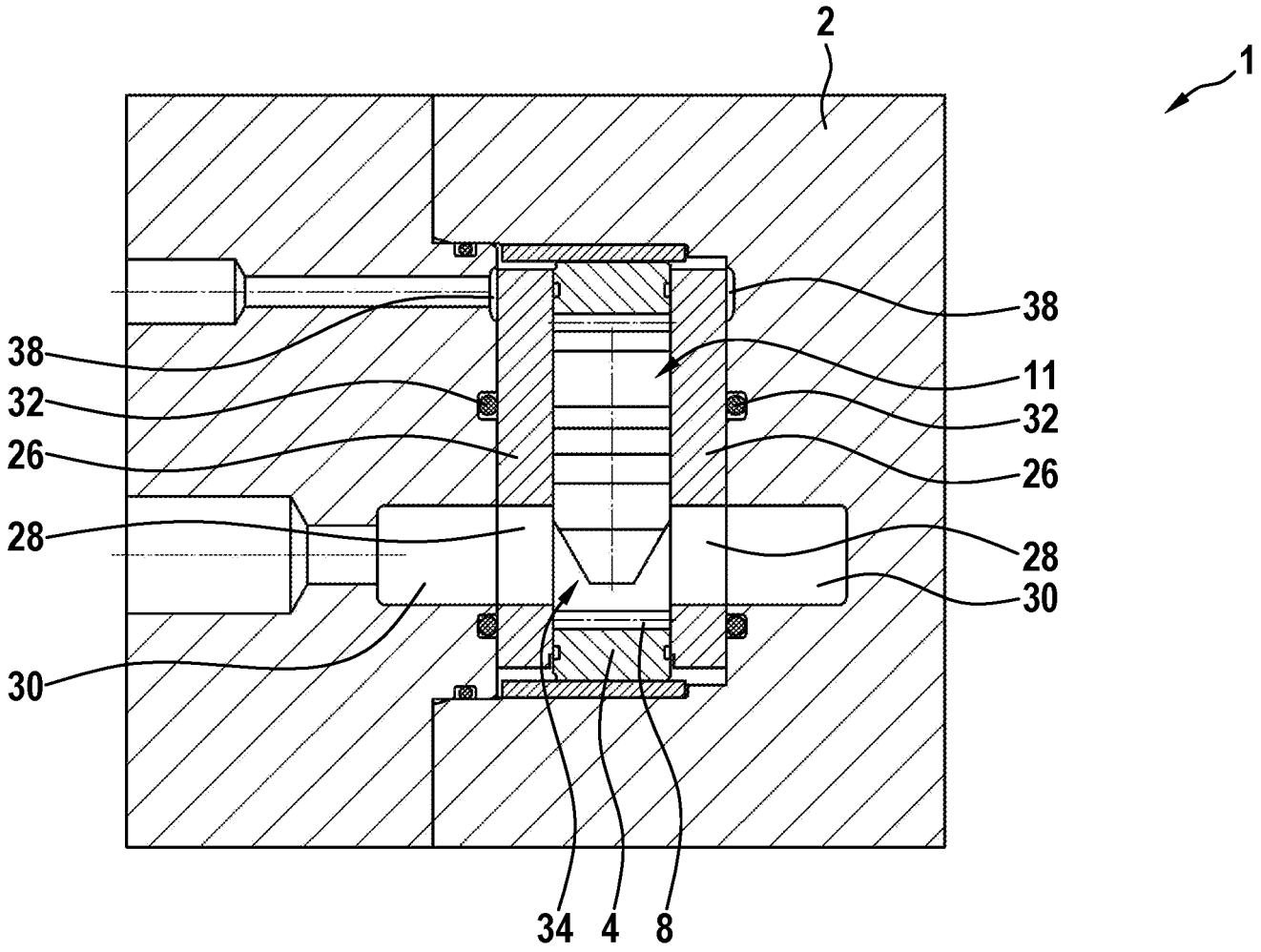
Figure 5:
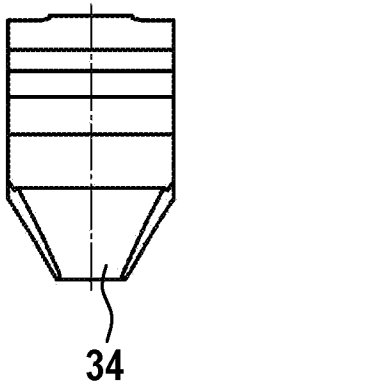
Figure 4:
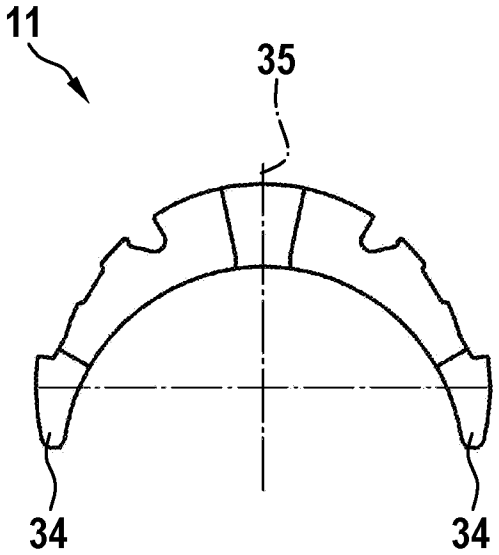

The invention is explained below with reference to the embodiments shown in the drawing, without any limitation of the invention. Thereby shows:

FIG. 1 a schematic cross-sectional view of an internal gear fluid machine,

FIG. 2 a schematic longitudinal sectional view of the internal gear fluid machine, FIG. 3 a further schematic longitudinal sectional view of the internal gear fluid machine, FIG. 4 a first detailed view of a filler piece of the internal gear fluid machine, as well as FIG. 5 a further schematic detailed view of the filler piece.

FIG. 1 shows a schematic cross-sectional view of an internal gear fluid machine 1, which has a machine housing 2 in which a first gearwheel 3 and a second gearwheel 4 are rotatably mounted. The first gearwheel 3 can also be referred to as a pinion and the second gearwheel 4 as a ring gear. The first gearwheel 3 is rotatably mounted about a first axis of rotation 5 and the second gearwheel 4 is rotatably mounted about a second axis of rotation 6 in the machine housing 2. It can be seen that the first axis of rotation 5 and the second axis of rotation 6 are arranged parallel to and spaced apart from each other, so that the first gearwheel 3 and the second gearwheel 4 therefore have different axes of rotation. The first gearwheel 3 has external toothing 7 and the second gearwheel 4 has internal toothing 8, which mesh with each other in an engagement region 9, i.e. are in engagement with each other.

The first gearwheel 3 and the second gearwheel 4 together delimit a fluid space 10. The first gearwheel 3 here delimits the fluid space 10 in a radially inward direction and the second gearwheel 4 in a radially outward direction. The fluid space 10 is divided into a first fluid chamber 12 and a second fluid chamber 13 in the circumferential direction by the meshing of the gearwheels 3 and 4 on the one hand and a filler piece 11 on the other. Depending on the direction of rotation of the internal gear fluid machine 1, one of the fluid chambers 12 and 13 is a suction chamber and another of the fluid chambers 12 and 13 is a pressure chamber.

In the embodiment example shown here, the filler piece 11 is symmetrical in order to enable reversing operation of the internal gear fluid machine 1. The internal gear fluid machine 1 can thus be operated in both directions of rotation. Additionally or alternatively, the filler piece 11 is designed in several parts and has several segments 14 and 15 or 16 and 17. The segments 14 and 15 or 16 and 17 are subdivided in the radial direction. Accordingly, the first segment 14 or 16 is in contact with the first gearwheel 3 and the second segment 15 or 17 is in contact with the second gearwheel 4.

Between the segments 14 and 15 or 16 and 17 there is a gap 18 or 19, which can be pressurised with fluid. This pressurisation of the fluid forces the segments 14 and 15 or 16 and 17 in the direction of the respective gearwheel 3 or 4. This results in radial compensation of the internal gear fluid machine 1.

Furthermore, it can be seen that the second gearwheel 4 is surrounded in the circumferential direction at least in some areas, in particular only in some areas, by one or more bearing recesses 20. The bearing recesses 20 are fluidically connected to fluid connections 21 and 22 of the internal gear fluid machine 1 (not shown here), preferably in each case via a flow resistance 23. The flow connections between the respective bearing recess 20 and the fluid connections 21 and 22 can be established via a respective connection channel 24 or 25. The bearing recesses 20 are designed in such a way that they are at least temporarily acted upon by pressurised fluid, for example from the fluid connections 21 and 22, so that they form a hydrostatic bearing for the second gearwheel 4.

It can be provided that one of the bearing recesses 20 is only fluidically connected to that of the fluid connections 21 and 22 which is assigned to a pressure side of the internal gear machine 1. This is particularly the case if the internal gear machine 1 is not reversible or is only operated in a preferred direction of rotation. However, if the internal gear machine 1 is designed for reversible operation and is operated with intermittently changing directions of rotation, the bearing recesses 20 are preferably fluidically connected to both fluid connections 21 and 22, namely one of the bearing recesses 20 to the fluid connection 21 and another of the bearing recesses 20 to the fluid connection 22. Thus, one of the bearing recesses 20 is always pressurised with the pressure present on the pressure side of the internal gear fluid machine 1, whereas the other of the bearing recesses 20 is pressurised with any pressure, for example with the pressure present on the suction side, which is lower.

FIG. 2 shows a longitudinal sectional view of the internal gear fluid machine 1. It can be seen that the gearwheels 3 and 4 are mounted axially in the machine housing 3 by means of—purely optional—sealing washers 26. The sealing discs 26 are arranged on opposite sides of the gearwheels 3 and 4 and lie against them in a sealing manner during operation of the internal gear fluid machine 1. First axial apertures 27 and second axial apertures 28 are formed in the sealing discs 26. The axial apertures 27 and 28 completely penetrate the respective sealing disc 26 in the axial direction.

It can be seen that the axial apertures 27 and 28 each widen in the direction of the gearwheels 2 and 4. For example, the axial openings 27 and 28, as seen in section, are aligned on their side facing the gearwheels 3 and 4 in the radially inward direction with a root circle of the external toothing 7 and/or in the radially outward direction with a root circle of the internal toothing 8, whereby only the former is shown here. At least the axial openings 27 and 28, seen in section, lie between the root circle of the external toothing 7 and the root circle of the internal toothing 8, i.e. do not project beyond them in the radial direction. This ensures a high efficiency of the internal gear fluid machine 1.

The axial openings 27 are arranged on both sides of the first fluid chamber 12 and the second axial openings 28 on both sides of the second fluid chamber 13. The first fluid chamber 12 is fluidically connected to the first fluid connection 21 via the first axial openings 27. Similarly, the second fluid chamber 13 is fluidically connected to the second fluid connection 22 via the second axial openings 28. Interface channels 29 and 30 are formed in the machine housing 2 for this purpose. The first axial apertures 27 are connected to the respective fluid connections 21 and 22 via the interface channels 29 and the second axial apertures 28 are connected to the respective fluid connections 22 via the second interface channels 30. The sealing discs 26 and the axial openings 27 formed in them can be omitted. In this case, there is a direct flow connection between the interface channels 29 and 30 and the fluid chambers 12 and 13. Of course, only one of the sealing discs 26 can be realised.

In the embodiment example shown here, one of the connection channels 29 opens directly into the corresponding fluid connection 21 or 22, whereas the other of the connection channels 29 and 30 is connected to the corresponding fluid connection 22 via the respective connection channel 24 or 25. The connection channels 24 and 25 completely overlap the gearwheels 3 and 4 and the sealing discs 26 in the axial direction.

As shown here, it can be provided that the first interface channels 29 open into the respective fluid connection 21 or 22 in the axial direction and the connection channels 24 and 25 open into the respective fluid connection 22 in the radial direction. The axial openings 27 and 28 are each surrounded by a seal 31 or 32, which ensures a fluid-tight connection of the respective axial opening 27 or 28 to the respective interface channel 29 or 30.

It can be seen that the axial discs 26 have common dimensions in the axial direction which correspond at least to the dimensions of the gearwheels 3 and 4 in the same direction. Due to these large dimensions in the axial direction, a particularly reliable mounting of the gearwheels 3 and 4 in the machine housing 2 is achieved. In particular, tilting of the axial discs 26 and an associated uneven sealing of the fluid chambers 12 and 13 is reliably prevented.

FIG. 3 shows a further longitudinal sectional view of the internal gear fluid machine 1. It is clear that the filler piece 11 extends in the circumferential direction as far as the axial apertures 28 and ends in the area of the axial apertures 28. The same naturally applies analogously to the first axial apertures 27. The filler piece 11 has a taper 34 through which it tapers in the axial direction, in the embodiment example shown here on both sides. The taper 34 is formed at the end of the filler piece 11 in the circumferential direction.

The taper 34 ends—also seen in the circumferential direction—in overlapping with the axial aperture 28, so that the filler piece 11 in overlapping with the axial aperture 28 has dimensions in the axial direction which correspond to the distance of the two sealing discs 26 from each other. Only when overlapping with the axial aperture 28 does the filler piece 11 begin to taper in the direction of its free end. The taper 34 results in optimised flow guidance so that the fluid can flow unhindered into or out of the respective fluid chamber 12 or 13.

A pressure field is preferably formed away from the seal 32, which can be acted upon by pressurised fluid to apply a force directed towards the gearwheels 3 and 4 to the sealing discs 26. For example, fluid is supplied to the pressure field from one of the fluid connections 21 and 22 or both fluid connections 21 and 22. A corresponding fluid connection can be realised for this purpose. The described design ensures that the fluid chambers 12 and 13 are reliably sealed in the axial direction by the sealing discs 26.

FIG. 4 shows a first detailed representation of the filler piece 11, which is symmetrical in the circumferential direction, i.e. has at least one axis of symmetry 35 with respect to which it is mirror-symmetrical. A taper 34 is formed at each end of the filler piece in the circumferential direction. The filler piece 11 has an extension in the circumferential direction of at least 180°, preferably more than 180°, in particular at least 190°, at least 200°, at least 210° or at least 220°. In the embodiment example shown here, the extension in the circumferential direction is at least 225°. The described design of the filler piece 11 enables reversible operation of the internal gear fluid machine 1, i.e. operation with any direction of rotation. It is also possible to operate the internal gear fluid machine 1 as a pump and/or as a motor without having to change over. In addition, it ensures reliable sealing of the fluid chambers 12 and 13 from each other in the circumferential direction.

FIG. 5 shows a further schematic representation of the filler piece 11, whereby the end taper 34 on both sides can once again be seen. This enables a particularly effective inflow of the fluid into the fluid chambers 12 and 13 or an outflow from them. Preferably, the filler piece has constant dimensions in the axial direction away from the taper 34 or the tapers 34.

FIGS. 1 and 4 also show a return line 36 via which fluid, in particular leakage fluid, can be discharged from the internal gear fluid machine 1 and/or supplied again to the internal gear fluid machine 1 or the respective suction chamber. For example, the return 36 is connected directly to the suction side or the suction chamber. However, it can also be provided that the return flow 36 is fluidically connected to a fluid tank. This fluid tank can be part of the internal gear fluid machine 1, but can also be separate from it. For example, it is fluidically connected to the suction side of the internal gear fluid machine 1. Viewed in the circumferential direction, the return 36 is arranged approximately centrally with respect to the filler piece 11, preferably exactly centrally. Particularly preferably, the return 36 is symmetrical with respect to an imaginary plane which accommodates both the first axis of rotation 5 and the second axis of rotation 6.

The return 36 has a return recess 37 which reaches through an inner circumferential surface of the machine housing 2 facing the second gearwheel 3, so that the return recess 37 is open in the direction of the gearwheels 3 and 4. In addition, the return 36 has return pockets 38, which are preferably in flow communication with the return recess 37. While the return recess 37, as seen in the axial direction, overlaps the gearwheels 3 and 4, the return pockets 38, as seen in the axial direction, are on both sides of the gearwheels 3 and 4, in particular they are formed on the sides of the sealing discs 26 in the machine housing 2 facing away from the gearwheels 3 and 4.

The fluid can be discharged via the return 36, i.e. via the return recess 37 and the return pockets 38, and preferably supplied again to the respective suction chamber. For example, the bearing recess 20 opens into the return recess 37. It may be provided that the bearing recesses limiting the bearing recess 20 in the axial direction also limit the return recess 37 in the axial direction. Preferably, however, the bearing recesses 20 are spaced apart from the return recess 37 in the circumferential direction. Preferably, the bearing recesses are symmetrical with respect to the return recess 37, in particular they have the same distance to it.

The flow resistances 23 are provided in order to limit the amount of leakage fluid, in particular also at a pressure that significantly exceeds an ambient pressure both on the suction side and on the pressure side. These are preferably identical in design and have, for example, a smallest diameter over their respective extension, which is at least 15 l/m2 and at most 75 l/m2 in relation to a displacement volume of the internal gear fluid machine 1. In this way, effective mounting of the second gearwheel 4 in the machine housing 2 can be achieved and, at the same time, a significant reduction in the amount of leakage fluid can be made. One of the flow resistances 23 is fluidically arranged between one of the bearing recesses 20 and the pressure side, and another of the flow resistances is fluidically arranged between another of the bearing recesses 20 and the suction side of the internal gear fluid machine. A fluidic connection between the bearing recesses 20 is preferably only present via unavoidable leakages and/or via the internal gear fluid machine 1 itself, i.e. via the fluid space 10 or at least one or both of the fluid chambers 12 and 13.

The described design of the internal gear fluid machine 1 enables particularly efficient fluid guidance and a high fluid throughput. In addition, due to the symmetrical design of the filler piece 11, it can be operated reversibly and/or can be pressurised both on its pressure side and on its suction side. Since the filler piece 11 has a multi-part design, a four-segment internal gear fluid machine is realised, which ensures effective sealing of the fluid chambers 12 and 13 from each other in any direction of rotation in the circumferential direction by means of the filler piece 11.

The invention claimed is:

1. An internal gear fluid machine comprising:

a first gearwheel having external toothing and mounted rotatably about a first axis of rotation and a second gearwheel having internal toothing meshing in regions with the external toothing in an engagement region and mounted rotatably about a second axis of rotation different from the first axis of rotation; and a filler piece arranged between the first gearwheel and the second gearwheel away from the engagement region, which filler piece bears on a first side against the external toothing and bears on a second side against the internal toothing, in order to divide a fluid space present between the first gearwheel and the second gearwheel into a first fluid chamber and a second fluid chamber, wherein housing walls of a machine housing of the internal gear fluid machine are arranged in an axial direction with respect to the first axis of rotation on both sides of the first gearwheel and the second gearwheel, and wherein, in order to form a hydrostatic bearing, the second gearwheel is surrounded in a circumferential direction at least in regions by at least one bearing recess which is formed in the machine housing, which bearing recess engages at least partially over the second gearwheel in the axial direction and is fluidically connected to a fluid connection of the internal gear fluid machine via a fluid line having a flow resistance.

2. The internal gear fluid machine according to claim 1, wherein the fluid line extends radially outwards from the at least one bearing recess and/or is straight throughout.

3. The internal gear fluid machine according to claim 1, wherein the fluid line opens radially inwards into the at least one bearing recess by passing through a bottom of the at least one bearing recess to form a muzzle opening.

4. The internal gear fluid machine according to claim 1, wherein the fluid line opens on its side facing away from the at least one bearing recess into a dimensionally larger connection channel, via which it is fluidically connected to the fluid connection.

5. The internal gear fluid machine according to claim 1, wherein a cross-sectional constriction is formed only locally in the fluid line, so that a flow cross-section of the fluid line on both sides of the cross-sectional constriction is larger than a flow cross-section in a region of the cross-sectional constriction.

6. The internal gear fluid machine according to claim 1, wherein the at least one bearing recess is fluidically connected on a side facing away from the fluid line via a leakage gap to a return recess of the internal gear fluid machine, which recess is in flow connection with a suction side of the internal gear fluid machine directly and/or with a fluid tank.

7. The internal gear fluid machine according to claim 1, wherein an interface channel is formed in each of the two housing walls and a common one of the first and second fluid chambers is in fluid connection with the fluid connection of the internal gear fluid machine via both interface channels.

8. The internal gear fluid machine according to claim 1, wherein the fluid connection is a first fluid connection of a plurality of fluid connections and the first fluid chamber is in flow order with the fluid connection present as the first fluid connection via the interface channels present as first interface channels, and in that a second interface channel is formed in each of the housing walls and the second fluid chamber is in fluid connection with a second fluid connection of the internal gear fluid machine via the second interface channels.

9. The internal gear fluid machine according to claim 8, wherein the fluid line opens on its side facing away from the at least one bearing recess into a dimensionally larger connection channel, via which it is fluidically connected to the fluid connection, and wherein one of the interface channels is connected directly and another of the interface channels is connected fluidically to the fluid connection via the connection channel which overlaps the first gearwheel and the second gearwheel in the axial direction.

10. The internal gear fluid machine according to claim 8, wherein the at least one bearing recess is a first bearing recess of a plurality of bearing recesses and the flow resistance is a first flow resistance of a plurality of flow resistances and a second of the bearing recesses is formed in the machine housing spaced in the circumferential direction from the first bearing recess, which at least partially overlaps the second gearwheel in the axial direction, the first bearing recess being fluidically connected to the first fluid connection via the first flow resistance and the second bearing recess being fluidically connected to the second fluid connection via a second of the flow resistances.

* * * * *